United States Patent [19]

Sogabe et al.

[11] Patent Number: 4,567,093

[45] Date of Patent: Jan. 28, 1986

[54] RUBBER COATED FABRIC

[75] Inventors: Yoji Sogabe, Ashikaga; Katsumi Uchida, Ohta; Kunihiko Harada, Ashikaga, all of Japan

[73] Assignee: Achilles Corporation, Tokyo, Japan

[21] Appl. No.: 488,010

[22] Filed: Apr. 25, 1983

[51] Int. Cl.[4] ..... B32B 25/10; B32B 25/02; B32B 5/28

[52] U.S. Cl. ..... 428/250; 428/252; 428/263; 428/267; 428/283; 428/284; 428/423.9; 428/402; 428/913

[58] Field of Search ..... 428/250, 252, 267, 284, 428/283, 402, 403, 492, 476, 913, 263, 423.9; 525/75, 68

[56] References Cited

U.S. PATENT DOCUMENTS

| | | | |
|---|---|---|---|
| 989,967 | 4/1911 | Headson | 428/263 |
| 1,402,918 | 1/1922 | Carlisle | 428/263 |
| 1,457,892 | 6/1923 | Blackwelder | 428/263 |
| 1,776,879 | 9/1930 | Baekeland | 428/263 |
| 1,784,523 | 12/1930 | Hopkinson | 428/263 |
| 4,004,059 | 1/1977 | Deiner et al. | 428/422 |
| 4,097,642 | 6/1978 | Dear et al. | 428/422 |
| 4,366,299 | 12/1982 | Dessiant | 428/422 |
| 4,389,509 | 4/1983 | Pamporichilids et al. | 528/75 |

*Primary Examiner*—Paul J. Thibodeau
*Attorney, Agent, or Firm*—Ladas & Parry

[57] ABSTRACT

A rubber coated fabric comprises a base fabric and a coating material laminated on at least one side of the base fabric. The coating material comprises, as its main ingredient, a product of reaction between liquid rubber and polyisocyanate. According to the invention, there are also provided methods for producing the rubber coated fabric comprising steps of mixing and stirring liquid rubber and polyisocyanate together in a mixing-dispensing machine and coating the mixed liquid rubber and polyisocyanate on a base fabric either directly or by means of a release paper or film. According to the invention, curing of the coating material is performed in a low temperature of 120° C. or below resulting in various advantages including saving of energy consumption, prevention of curling of the product and of volatilization of low-boiling point ingredients. In the rubber coated fabric, adhesion of dusting powder to the coating material is excellent and little dusting powder applied to the coating material comes off. If a fabric treated previously in a water and oil repellent is used as the base fabric, leaking of the coating material from the base fabric is prevented and a rubber coated fabric of excellent appearance, peeling resisting property and draping quality is obtained.

1 Claim, No Drawings

RUBBER COATED FABRIC

DETAILED DESCRIPTION OF THE INVENTION

This invention relates to a rubber coated fabric suitable for use as a material of a rubber boat, raincoat, rubber mat, etc. and a method for producing the same.

The rubber coated fabric has heretofore been manufactured by laminating a rubber film on a base fabric employing a calender topping method which includes steps of undercoating a base fabric with rubber cement, laying a rubber film sheeted from a calender on the base fabric and pressing and bonding them together by means of a press roller, and then applying dusting powder on the rubber film and vulcanizing the rubber film after brushing to form a rubber coated fabric.

This conventional method for producing a rubber coated fabric employing the calender topping method, however, requires a calender, which is a large and costly apparatus, and also requires a number of steps including undercoating, calender topping and vulcanization, resulting in complication of the process and requirements for a tremendous plant investment, and large space and manpower.

In addition the vulcanizing process normally is conducted under a heating condition of 130° C. or over which necessitates large consumption of energy.

In the manufacture of a rubber coated fabric, dusting powder is generally applied on its surface to impart a slip property to it for preventing adhesion of rubber coated fabric sheets to each other and maintaining an unsticky touch. In the rubber coated fabric produced by the conventional method, however, adhesion of dusting powder to the rubber coated fabric is generally poor and sufficient retention of dusting powder on the surface of the fabric cannot always be expected. Besides, as time elapses, dusting powder tends to come off from the fabric processed to a final product resulting in loss of the slip property from the product.

There has been practiced another method for producing a rubber coated fabric which includes steps of dissolving a rubber compound in a solvent, coating the dissolved rubber compound on a base fabric, vaporizing the solvent by heating in an oven to form a rubber layer on the base fabric, applying dusting powder on the rubber layer, brushing the surface on the rubber layer and vulcanizing under a high heat condition of 130° C. or over.

This method is also disadvantageous in that it includes the vulcanizing process which is conducted under the high heat condition as in the method employing the calender topping process with a resulting large energy consumption and that this method has the same deficiency in the retention of dusting powder as in the rubber coated fabric produced by the calender topping process.

In manufacturing a long sheet of rubber coated fabric, this conventional method is defective in that the dissolved rubber compound which is prepared prior to the coating of the rubber compound on the surface of the base fabric increases its viscosity as time elapses prior to the coating, resulting in difficulty in securing uniform coating on the base fabric and thus leading to yielding of inadequate products.

This conventional method has an additional disadvantage in a case where a relatively thick rubber layer is to be formed on the base fabric. Since the dissolved rubber compound contains a fairly large amount (over 50%) of solvent, the rubber layer formed on the base fabric would give rise to cells therein due partly to vaporizing of the solvent and partly to mixing of air resulting in yielding of inadequate products if the dissolved rubber compound was coated in single coating. The coating of the dissolved rubber compound must therefore be conducted in several repeated thin coating steps instead of a single thick coating step thus resulting in increase of the coating times.

It is, therefore, an object of the invention to eliminate the disadvantages of the conventional rubber coated fabric and the methods for producing the same.

According to the invention, there is provided a rubber coated fabric comprising a base fabric and a coating material laminated on at least one side of said base fabric, said coating material comprising, as its main ingredient, a product of reaction between liquid rubber and polyisocyanate.

According to the invention, there are also provided methods for producing the rubber coated fabric comprising steps of mixing and stirring liquid rubber and polyisocyanate together in a mixing-dispensing machine and coating the mixed liquid rubber and polyisocyanate on at least one side of a base fabric either directly or by means of a release paper or film to form a laminated rubber coated fabric.

As a base fabric of the rubber coated fabric, any material that is conventionally used as a base fabric of a rubber coated fabric can be utilized. For example, fabrics made of polyamide, polyester, polyurethane, polypropylene, vinylon, cotton and hemp constitute typical base fabrics to be used in the invention.

In order to prevent excessive penetration into the base fabric of the coating material including a mixture of liquid rubber and polyisocyanate, openings formed in the texture of the base fabric may be partially filled by rubber cement by applying a thin undercoating on the base fabric or such openings may be partially closed by melting a portion of yarn constituting the base fabric. For preventing the excessive penetration of the coating material, it is also effective to apply a water and oil repelling treatment to the base fabric previously by employing a water and oil repellent. The above described undercoating may be performed after applying such water and oil repelling treatment. For this purpose, any type of water and oil repellent which is generally used in the art may be utilized.

As a preferred type of such water and oil repellent, there are compounds containing a perfluoroalkyl group such as Scotchguard FC-232 (trademark) (made by Minnesota Mining and Manufacturing Co. emulsion including 30% solids), Scotchguard FC-905 (made by the same company, solution including 10% solids), Dicguard F-50 (trademark) (made by Dainippon Ink and Chemical Corp., emulsion including 14% solids), Asahiguard AG-710 (trademark) (made by Asahi Glass Chemical Corp., emulsion including 18% solids) and Asahiguard AG-650 (made by the same company, solution including 15% solids). These repellents may be used singly or in combination and in solution or emulsion. In view of efficiency as a repellent and danger involved in handling, emulsion including 10–30% solids is preferable. The amount of the repellent depositable to the base fabric is 10% or less, preferably 0.1%–1%, in solids per total weight of the base fabric. After application of the repellent to the base fabric, the base fabric is generally heated for drying and curing of the water and oil repellent. The heating is effected at 100° C. or over for 20 seconds to 10 minutes, preferably at 100° C. to 170° C. for 20 seconds to 3 minutes. Silicone compounds having water and oil repelling property may also be used. If necessary, an antistatic agent, a flame resister or a water and oil repellent assistant may be added to the water and oil repellent. The water and oil repellent assistant enhances penetration of the water and oil repellent into the fabric texture. As this assistant, cationic, anionic and nonionic surface active agents and various solvents, for example, may suitably be employed singly or in combination.

The liquid rubber to be used in this invention means telechelic liquid rubber of an average molecular weight of 400–10,000 having fluidity at a room temperature and having at the end of the molecule a crosslinkable functional group such as a hydroxyl group, mercapto group and amino group. Polybutadiene, polyisoprene, polychloroprene, butadiene-isoprene copolymer, acrylonitryl-butadiene copolymer and styrene-butadiene copolymer are typical telechelic liquid rubber and these may be used singly or in combination.

As the liquid rubber, particularly preferable is liquid polybutadiene having an active hydrogen group, e.g. hydroxyl group, at the molecule end, particularly highly reactive liquid polybutadiene having an allyl type primary hydroxyl group at the molecule end.

One or more compounds used generally for improving properties of liquid rubber such as a filler, cross-linker, age resister, process oil, urethanating catalyst, blending polyol, pigment and solvent may be added to the liquid rubber to be used in the invention.

As the filler, all types of fillers usable in solid rubber can be used singly or in combination. These fillers are, for example, calcium carbonate, active calcium carbonate, clay, white carbon, various carbon blacks, aluminum hydroxide, zinc oxide, aluminum sulfate, calcium sulfate, talc, magnesium carbonate, mica, asbestos, pumice powder, rubber powder, wood flour, cork powder, PVA fibre and cellulose powder. The amount of the filler to be added to the liquid rubber is 300 parts or less by weight to 100 parts of the liquid rubber, preferably 10–200 parts by weight.

As the cross-linker, hydroxyl compounds of a low molecular weight having two or more functional groups may preferably be used. They are, for example, 1,4-butanediol, 1,5-pentanediol, ethyleneglycol, diethyleneglycol, 1,6-hexanediol, neopentylglycol, glycerin, diethanolamine, triethanolamine, trimethylolpropane, hydroquinone, bisphenol A, N,N-bis(2-hydroxypropyl) aniline, N,N-bis(2-hydroxyethyl) aniline and ethylenediamine. The mixing ratio of the cross-linker and the liquid rubber is 50 parts or less by weight, preferably 1–20 parts, of the cross linker per 100 parts of the liquid rubber.

As the age resister, conventional ultraviolet ray absorbers, anti-oxidants or the like age resisters may be used. For example, benzotriazoles, benzophenones, salicylic acid derivatives, monophenols, naphthylamines, phenylenediamines, polyphenols, carbamates and waxes may be used singly or in combination. The mixing ratio of the age resister and the liquid rubber is 20 parts or less by weight, preferably 0.1–10 parts, of the age resister per 100 parts of the liquid rubber.

Suitable process oils include aromatic, naphthenic and paraphinic lubricating oils, e.g., spindle oil, plasticizers such as DOP and vegetable oils. These process oils can be used singly or in combination. The mixing ratio of the process oil and the liquid rubber is 100 parts or less by weight, preferably 50–100 parts, of the process oil per 100 parts of the liquid rubber.

As the urethanating catalyst, any conventional urethanating catalysts, e.g., amines and organotin compounds, may suitably be used singly or in combination. Amines suitable for use include triethylamine, triethylenediamine, N,N,N', N'', N''-pentamethyl diethylene triamine, N,N,N',N'-tetramethyl hexamethylene diamine, N-methyl morpholine and N-ethylmorpholine. Organotin compounds suitable for use include dibutyltindilaurate, dibutyltindiacetate, dibutyltindi-2-ethylhexanate, dioctyltindiacetate and stannous octate.

As the blending polyols, all polyols used for urethanating which are blendable with the liquid rubber may be used. Suitable polyols include both polyester polyol and polyether polyol. These polyols may be of any number of functional groups and of any molecular weight but those having multiple primary hydroxyl groups at the molecule ends are preferable.

As the pigment, both organic and inorganic pigments are suitable for use. If necessary, other additives such as flame resister and antistatic agent may be added.

The solvents suitable for use in this invention include hydrocarbons (e.g., n-butane, n-pentane, n-hexane, gasoline, petroleum spirit and cyclohexane), aromatic hydrocarbons (e.g., benzene, toluene, xylene and ethylbenzene), halogenic hydrocarbons (e.g., methyl chloride, methylene chloride, chloroform, carbon tetrachloride, ethyl chloride, ethylene chloride, trichloroethane, tetrachloroethane, trichloroethylene, tetrachloroethylene, trichloromonofluoromethane and dichlorodifluoromethane), halogenic aromatic hydrocarbons (e.g., chlorobenzene, chlorotoluene and bromobenzene), ethers (e.g., ethylether, isopropylether, dioxane and tetrahydrofuran), ketones (e.g., acetone, methyl acetone, methyl ethyl ketone, methyl isobutyl ketone and cylcohexanone) and esters (e.g., ethyl acetate, methyl acetate, isobutyl acetate, ethyl propionate and methyl propionate). As the solvents, water and alcohols may also be used. By adding a suitable amount of such solvent to the liquid rubber compound, viscosity of the compound can be adjusted so that processing and mixing with isocyanate may be facilitated. The amount of the solvent to be added is 100 parts or less by weight, preferably 1–10 parts, per 100 parts of the liquid rubber.

The above described various additives to the liquid rubber may be sufficiently blended by means of a conventional rubber cement mixer. If necessary, these additives may preferably be blended through a three-roll mill for more uniform blending.

As the polyisocyanate to be mixed with the liquid rubber, any polyisocyanates generally used for urethanes may suitably be used. Such polyisocyanates include hexamethylene diisocyanate, biphenyl diisocyanate, tolylene diisocyanate, diphenyl methane diisocyanate and naphthalene diisocyanate, and modifiers, derivatives and crude materials thereof. Such polyisocyanates may be of any NCO/OH ratio but the NCO/OH ratio of 100–110/100 is preferred.

Methods for producing the rubber coated fabric according to the invention will now be described.

Liquid rubber and polyisocyanate are previously stored in separate reservoirs and these materials are supplied continuously to a mixing-dispensing machine from their respective reservoirs. The liquid rubber and polyisocyanate are mixed and stirred by the mixing-dispensing machine and then are dispensed directly on the base fabric. The mixture of the liquid rubber and polyisocyanate provided on the base fabric is coated on the base fabric by using a doctor knife or like device. The mixture is coated at least on one side of the base fabric and may be coated on both sides thereof.

The base fabric thus coated with the mixture of liquid rubber and polyisocyanate thereafter is cured for cross-linking in a cross-linking kiln at the room temperature to 120° C. for 3–10 minutes. Thus, a rubber coated fabric having a coating material laminated on a base fabric is obtained. The coating material comprises, as its main ingredient, a product of reaction between liquid rubber and polyisocyanate.

According to the invention, these is provided an alternative method for laminating the reaction product on the base fabric. In this alternative method, liquid rubber and polyisocyanate are mixed together in the mixing-dispensing machine and the mixture is dispensed on a release paper or film and coated uniformly thereon by means of a doctor knife or like device. The mixture is then brought into a semicross-linked state in a first cross-linking kiln. The base fabric and the release paper are pressed together by a press roller in such a manner that the coated side of the release paper faces the base fabric. The laminated base fabric and the release paper thereafter are processed in a second-linking kiln for complete cross-linking and then the release paper is peeled off, leaving the layer of the reaction product of liquid rubber and polyisocyanate on the base fabric.

The cross-linking in the first cross-linking kiln is conducted at the temperature of 120° C. or below, preferably 80°–120° C., for 60 minutes to 30 seconds, preferably 10 minutes to 30 seconds. The cross-linking in the second cross-linking kiln is conducted under the same heating condition as in the case where the mixture of the liquid rubber and polyisocyanate is coated directly on the base fabric. As the release paper or film, a silicone or polypropyrene release paper or a polyethylene terephthalate film, for example, may suitably be used.

Dusting may be applied to the rubber coated fabric produced according to the above described processes for providing the fabric with slip property and thereby reducing stickiness on the surface of the rubber coated fabric. For dusting, dusting powders used for conventional rubber products may conveniently be used. Suitable dusting powders include talc, silica, ebonite powder, zinc stearate, zinc oxide, magnesium carbonate, calcium carbonate, clay and aluminum oxide. Reactive dusting powders having a hydroxyl group capable of reacting with polyisocyanates such as starches including wheat, sweet potato and celluloses may also be used. These reactive dusting powders are preferred for they have an excellent property of bonding with the reaction product.

The rubber coated fabric according to the invention is suitable for use as a material of rubber boats, raincoats and rubber mats. Its flexibility, water pressure resisting property, weather-proof property, tensile strength and tear resistance required for the material of these products are substantially equivalent to the prior are rubber coated fabric.

In the production of a long sheet fabric, the rubber coated fabric according to the invention employing liquid rubber and polyisocyanate as the coating material is advantageous because there arises no such problem of increase in viscosity with time as occurs in a rubber compound dissolved in a solvent, so that uniform and stable coating of the coating material can be ensured.

In the rubber coated fabric according to the invention, adhesion of dusting powder to the coating material is superior to the prior art rubber coated material employing solid rubber, and little dusting powder applied to the coating material comes off with lapse of time. Thus, a desirable slip property is maintained over a long period of time.

If a reactive dusting powder is used, adhesion of the dusting powder and maintenance of the slip property are enhanced, for, if the product of reaction between liquid rubber and polyisocyanate is in a semi-cross-linked state, the reactive dusting powder is bonded strongly to the product of reaction between liquid rubber and polyisocyanate due partly to reaction occurring between the reactive dusting powder and the product of reaction and partly to stickiness of the product of reaction in the semi-cross-linked state.

If a fabric treated previously in an oil repellent is used as the basic fabric, leaking of the coating material from the base fabric is prevented and a rubber coated fabric of excellent appearance, peeling resisting property and draping quality can be obtained.

According to the method of the present invention, since cross-linking is caused by urethanating reaction, vulcanization in a high temperature atmosphere of 130° C. or over which was essential in the prior art process for producing a rubber coated fabric is substituted by the cross-linking process which is conducted in a low temperature atmosphere of 120° C. or below. The method according to the invention, therefore, is very advantageous in that energy consumption is saved and deterioration and shrinkage of the base fabric and volatilization of low-boiling point ingredients due to the high temperature vulcanization can be prevented. Besides, since there occurs no curling of the rubber coated fabric due to the high temperature vulcanization, secondary processing of the rubber coated material such as sewing and adhesion can be performed smoothly resulting in improvement in the work efficiency. In the method according to the invention, solvents used in the prior art methods for forming a rubber layer on the base fabric need not be used at all or only a small amount of such solvents is used and, accordingly, saving of material can be achieved and the coating material need not be coated in several repeated coatings even in a case of producing a thick rubber coated fabric.

If the base fabric is treated in the water and oil repellent prior to coating of the liquid rubber on the base fabric, leaking of the coating material from the texture of the base fabric is prevented and, consequently, the cross-linking may be performed under less strict conditions than in the rubber coated fabric which is not treated in the water and oil repellent. The treatment of the base fabric in the water and oil repellent is also advantageous in that contamination of the rubber coated fabric by sewing oil in sewing the fabric can be prevented. In sewing a rubber coated material using a sewing machine, sewing oil used for facilitating passage of a sewing machine needle through the fabric frequently soils the fabric. By applying the water and oil repellent treatment, no contamination of the fabric by sewing oil takes place and, as a result, rubber coated fabrics of all colors including both pale and dark colors can be sewn freely and efficiently by a sewing machine. This is particularly advantageous in sewing a rubber coated fabric of a pale color, for a process of removing oil spots from the fabric during or after sewing as has been required in sewing the prior art rubber coated fabric is obviated.

The water and oil repelling treatment is also effective for preventing adhesion of powder and dust to the fabric during manufacturing thereof and adhesion of sands and dirt during use of the secondary products.

Further, since the prior act rubber coated fabric in which sulfur and a vulcanizing accelerator are blended must be cured at a high temperature of 130° C. or over, dyestuff used on the base fabric tends to change color and hence a base fabric of a pale color is unsuitable for use. According to the present invention, a base fabric of a pale color can be used without restriction, for there is no likelihood of color changing owing to the fact that curing is effected at a low temperature between the room temperature and 120° C. and that no sulfur or vulcanizing accelerator is blended in the liquid rubber.

The invention will be further described with reference to examples and comparison data. It should be noted that these examples are just illustrative and in no way restrict the scope of the invention.

EXAMPLE 1

| Ingredients of liquid rubber composition | |
|---|---|
| liquid polybutadiene rubber (poly BD R-45HT, ARCO Chemical Co.) | 100 parts by weight |
| filler (aluminum hydroxide) | 150 parts |
| cross-linker (N,N bis(2 hydroxypropyl) aniline | 5 parts |
| age resister (BHT) | 1 part |
| process oil (DOP) | 5 parts |
| pigment (titan oxide) | 10 parts |
| urethanating catalyst (dibutyl tin dilaurate) | 0.01 part |

The above composition having viscosity of 40,000 cps (measured by Brookfield viscometer at 25° C.) was mixed uniformly in a mixer and supplied to a first reservoir. Then, polyisocyanate (Millionate MTL(trademark) made by Nippon Polyurethane Co. Ltd.) was supplied to a second reservoir. The liquid rubber composition and polyisocyanate were supplied to a mixing-dispensing machine from the respective reservoirs and the two liquid materials with their NCO-/OH index adjusted to 105 were continuously mixed and stirred. The mixed materials thereafter were dispensed on a nylon yarn and continuously coated thereon at a coating rate of 300 g/m$^2$. The coated layer was then cured at 80° C. for 4 minutes for cross-linking, wheat starch was applied on the surface of the coated layer for dusting and, after brushing, the fabric was wound up and a finished rubber coated fabric was thus obtained.

EXAMPLE 2

The composition of the same mixing and dispensing ratios as in Example 1 was continuously coated on a silicone release paper at a coating rate of 100 g/m$^2$. The coated release paper was cured in a first cross-linking kiln at 100° C. for 2 minutes to bring the coated layer into a semicrosslinked state. The coated release paper thereafter was laid on a nylon taffeta made of 100 warps and 90 wefts of 70 denir nylon yarn and the release paper and the nylon taffeta were pressed by a press roller to stick to each other. Then the release paper and the nylon taffeta were cured in a second kiln at 100° C. for 2 minutes for complete cross-linking. After the cross-linking, wheat starch was applied on the surface of the coated layer while the silicone release paper was peeled off and, after brushing, the fabric was wound up and a finished coated rubber fabric was thus obtained.

EXAMPLE 3

A nylon taffeta of the same type as used in Example 2 was first undercoated with a chloroprene rubber cement (50-% solids, toluol being used as solvent) at a coating rate of 40 g/m$^2$ and was dried immediately thereafter at 100° C. for 1 minute. Then, the liquid rubber composition of the same mixing ratio as in Example 1 and polyisocyanate were mixed in a mixing-dispensing machine at the same mixing ratio as in Example 1. The mixture was continuously dispensed on the undercoated nylon taffeta at a coating ratio of 100 g/m$^2$. The coated taffeta was heated in a cross-linking kiln for cross-linking at 100° C. for 2 minutes. Wheat starch was applied to the surface of the coated layer for dusting and, after brushing, the fabric was wound up and a finished rubber coated fabric was obtained.

EXAMPLE 4

A nylon taffeta made of 100 warps and 90 wefts of 70 denir nylon yarn was dyed and dipped immediately thereafter into a dipping bath containing a water and oil repellent comprising perfluoroalkyl group of the following composition, thus dyeing and water and oil repelling treatment processes being performed continuously:

| Ingredients of the water and oil repellent | parts by weight |
|---|---|
| Scotchguard FC-232 | 5 |
| Water | 95 |
| Finetex NRW-3 (Trademark) (surface active agent made by Dainippon Ink and Chemical Corp.) | 0.05 |

The dyeing and the water and oil repellent treatment were conducted at a speed of 50 m/minute.

Then, the dipped fabric was wrung by a mangle in such a manner that the pickup becomes 40% by weight of the nylon. The fabric was then heated at 160° C. for 30 seconds.

A liquid rubber mixture of the same mixing ratio as in Example 1 and polyisocyanate were continuously mixed in a mixing-dispensing machine at the same mixing ratio as in Example 1 and dispensed and coated on the nylon taffeta which has been treated in the dipping bath and coated thereon at a coating rate of 100 g/m$^2$. Then, the fabric was cured in a cross-linking kiln at 100° C. for 3 minutes for cross-linking. After dusting by wheat starch and subsequent brushing, the fabric was wound up and a finished rubber coated fabric was thus obtained.

EXAMPLE 5

A rubber coated fabric was produced in the same manner as in Example 1 except that the cross-linking was performed at 120° C. for 2 minutes.

EXAMPLE 6

A rubber coated fabric was produced in the same manner as in Example 4 except that the cross-linking was performed at 90° C. for 5 minutes.

EXAMPLE 7

A nylon taffeta of the same type as the one used in Example 4 was treated with a water and oil repellent of the following composition at a processing speed of 15 m/minute:

| Ingredients of the water and oil repellent | parts by weight |
|---|---|
| Scotchguard FC-232 | 5 |
| Water | 95 |

Then, the fabric was processed in the same manner as in Example 4 and a finished rubber coated fabric was obtained.

EXAMPLE 8

A nylon taffeta of the same type as used in Example 4 was treated with a water and oil repellent in the same manner as in Example 4 except that the water and oil repellent was of the following composition:

| Ingredients of the water and oil repellent | parts by weight |
|---|---|
| Scotchguard FC-905 | 5 |
| Mineral terpene | 95 |

Then, employing a liquid rubber mixture of the same mixing ratio as in Example 4 except that viscosity was 90,000 cps/25° C., a rubber coated fabric was produced in the same manner as in Example 4 except that the coating rate was 110 g/m$^2$.

EXAMPLE 9

A nylon taffeta of the same type as used in Example 4 was treated with the same water and oil repellent as used in Example 4. Liquid rubber mixture of the same mixing ratio and polyisocyanate were mixed together at the same mixing ratio and continuously dispensed and coated on a silicone release paper at a coating rate of 100 g/m$^2$. The coated material on the release paper was cured in a first cross-linking kiln at 90° C. for 3 minutes for bringing it into a semi-crosslinked state. The release paper thereafter was laid on the nylon taffeta which had been treated with the water and oil repellent and the release paper and taffeta were pressed to stick to each other by a press roller and were subsequently cured in a second cross-linking koln at 100° C. for 2 minutes. Dusting was effected using wheat starch while the silicone release paper was peeled off. After brushing, the fabric was wound up and a finished rubber coated fabric was obtained.

COMPARATIVE EXAMPLE 1

SBR undercoating rubber cement was coated on base fabric made of a nylon taffeta of the same type as used in Example 1 at a coating rate of 30 g/m$^2$. The undercoated base fabric was heated at 100° C. for 1 minute and wound up. Then, an SBR rubber film sheeted from a calender at a rate of 100 g/m$^2$ was superposed on the undercoated base fabric by calender topping. Wheat starch was applied for dusting and the fabric was wound up after brushing. The fabric was subsequently cured at 150° C. for 5 minutes and a finished rubber coated fabric was obtained.

COMPARATIVE EXAMPLE 2

The undercoating was performed under the same condition as in Comparative Example 1 on a nylon taffeta of the same type as used in Comparative Example 1. Solid SBR was dissolved by a mixed solvent of toluene and D gasoline (mixed at a ratio of 1/1) and adjusted to 50% of solids. This dissolved SBR was coated on the undercoated base fabric at a coating rate of 100 g/m$^2$. The fabric was heated at 100° C. for 2 minutes and wound up. Then the dissolved SBR was coated again at a coating rate of 80 g/m$^2$ on the SBR coated fabric and further heated at 100° C. for 2 minutes. Wheat starch was applied for dusting and the fabric was wound up after brushing. The fabric was subsequently cured under 150° C. for 5 minutes and a finished rubber coated fabric was obtained. In carrying out this method, the second preparation of the dissolved SBR for coating was made 30 minutes after the first preparation for avoiding increase in viscosity in the dissolved SBR. It should be noted that the base fabrics used in the above Examples 1–9 and Comparative Examples 1 and 2 were all of a pale pink color.

RESULTS OF EXPERIMENTS

Peel strength, slip property, stability of slipperiness and curling property were tested with respect to the rubber coated fabrics obtained by the methods of the above described Examples and Comparative Examples. The peel test was conducted by buffing the surface of the rubber layer of the product to be tested, coating the surface of the rubber layer with chloroprene rubber cement (50% solid, the solvent being toluene) added with polyisocyanate Desmodur RF (trademark, made by Bayer) at a ratio of 3 parts by weight of polyisocyanate per 100 parts chloroprene rubber cement, adhering the surface of the rubber layer of another sheet of the rubber coated fabric to the rubber cement, curing the rubber cement and measuring peel strength for peeling the rubber layer from the base fabric.

The slip property was measured by placing a 10 cm×10 cm piece of the rubber coated fabric to be tested on an aluminum plate having width of 20 cm, length of 50 cm and thickness of 3 mm with the surface of the rubber layer contacting the surface of the aluminum plate lifting gradually one end of the aluminum plate in the longitudinal direction with the other end of the plate fixed, and recording the angle of the plate when the piece of the fabric starts to slide. A greater angle signifies a lower slip property on the surface of the rubber layer.

The stability of slipperiness (i.e., ability to maintain slipperiness) was measured by washing a 10 cm×10 cm piece of the rubber coated fabric by a washing machine for 30 minutes and subsequently measuring slip property of the test piece in the above described manner after drying it.

The curling property was measured visually after leaving a 30 cm×30 cm piece of the rubber coated fabric to be tested in the atmosphere of temperature of 30° C. and humidity of 80% for 24 hours. In the table below, the curling property is assessed by the following standards:

A: End portions of the test piece curled slightly.

B. About half of the test piece curled.

C: The entire test piece curled in the form of a roll.

A is the best, B is fair and C is the worst. Discoloration of the base fabric during the crosslinking process in the Examples of the invention and the vulcanizing process in the Comparative Examples was measured by employing the contamination grey scale of JIS L 0805. Rating 5 is the best and the smaller the value, the greater the discoloration down to Rating 1 which represents the worst discoloration.

Results of these tests are listed in the following Table 1.

TABLE 1

| | Peel strength (kg/cm) | Slip (degree) | Slip after washing 30 min (degree) | Curling | Discoloration of base fabric (rating) |
|---|---|---|---|---|---|
| Example 1 | 1.10 | 30 | 35 | A | 5 |
| 2 | 1.15 | 32 | 38 | A | 5 |
| 3 | 1.10 | 30 | 36 | A–B | 5 |
| 4 | 1.20 | 30 | 36 | A | 5 |
| 5 | 1.10 | 32 | 38 | A | 5 |
| 6 | 1.15 | 32 | 38 | A | 5 |
| 7 | 1.20 | 30 | 37 | A | 5 |
| 8 | 1.15 | 31 | 38 | A–B | 5 |
| 9 | 1.10 | 30 | 37 | A | 5 |
| Comparative example 1 | 1.10 | 40 | 48 | C | 3 |
| 2 | 0.95 | 45 | 50 | C | 3 |

As will be understood from the table, the rubber coated fabric according to the invention has a good peel strength substantially equivalent to the prior art fabric and is superior to the prior art fabric in the slip property, stability of slipperiness and curling property. Besides, it will be noted that discoloration of the base fabric does not occur in the Examples of the present invention whereas considerable discoloration occurs in the Comparative Examples. This is due to the fact that crosslinking in the present invention is effected at low temperatures of 80° C.–120° C. whereas in the Comparative Examples, vulcanization is effected at a high temperature of 150° C. and, moreover, sulfur and vulcanizing accelerator are blended in the rubber. These results indicate that a base fabric of a pale color which is unusable in the prior art rubber coated fabric can be used freely according to the present invention.

What we claim is:

1. A rubber coated fabric comprising a base fabric and a coating material laminated on at least one side of said base fabric, said coating material comprising as its main ingredients, a product of reaction between liquid rubber and polyisocyanate wherein dusting powder is applied to the surface of said coating material, and said dusting powder is a reactive dusting powder containing a hydroxyl group capable of reacting with said polyisocyanate.

* * * * *